United States Patent [19]

Kleinfeld

[11] 4,431,114

[45] Feb. 14, 1984

[54] CONTAINER AND REMOVABLE COVER

[76] Inventor: Arnold Kleinfeld, 12 Kanes La., Huntington Bay, N.Y. 11743

[21] Appl. No.: 431,016

[22] Filed: Sep. 30, 1982

[51] Int. Cl.[3] ..... B65D 43/14; B65D 51/04

[52] U.S. Cl. ..... 220/337; 206/45.19; 206/45.34; 220/306

[58] Field of Search ..... 220/334, 337, 338, 306; 206/45.19, 45.34

[56] References Cited

U.S. PATENT DOCUMENTS

| | | | |
|---|---|---|---|
| 3,576,271 | 4/1971 | Seeley | 220/337 |
| 4,005,800 | 2/1977 | Schurman | 220/337 |
| 4,013,214 | 3/1977 | Hansen et al. | 206/45.34 |
| 4,340,140 | 7/1982 | Wilcox et al. | 206/45.19 |

*Primary Examiner*—George T. Hall

*Attorney, Agent, or Firm*—Ostrolenk, Faber, Gerb & Soffen

[57] ABSTRACT

An ornamental container for receiving and positioning small articles wherein the container has a front wall, back wall and side walls and an open top, a bottom wall shaped to position the articles and a ledge adjacent the upper ends of the walls. At least one slot, preferably a pair of slots, at the back wall are accessible above the ledge, the cover is provided with extending tangs insertable into the slots to form a hinge for the cover. Means are provided at the front of the cover for resiliently holding the cover closed when it is rotated about the tangs and slot as a hinge. The cover and the tangs are essentially co-planar. Detent means interengagable at the front wall above the ledge hold said cover in place when it is rotated to closed position about the hinge formed by the tangs and slots.

15 Claims, 27 Drawing Figures

FIG. 3
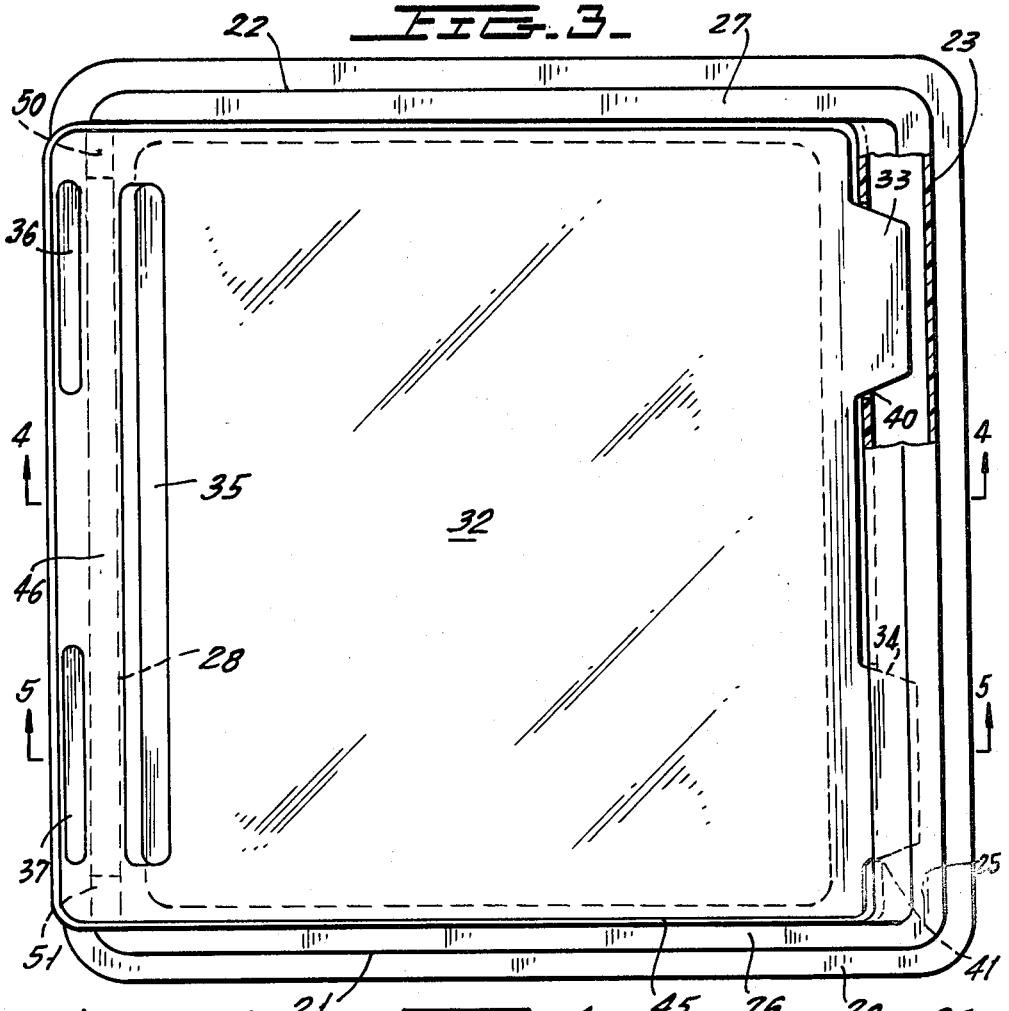
FIG. 4
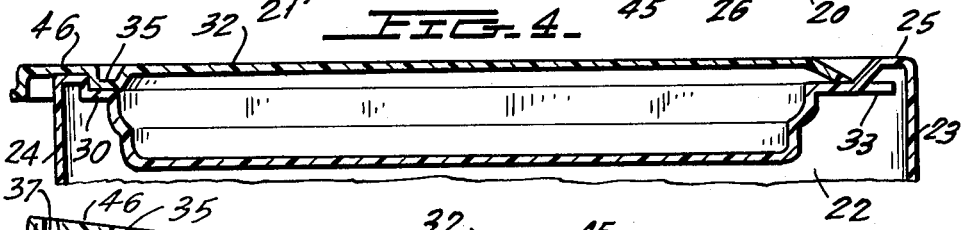
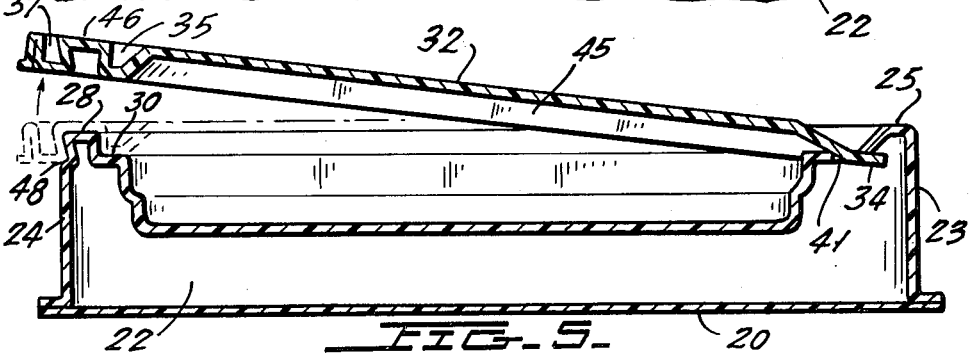
FIG. 5

FIG. 8
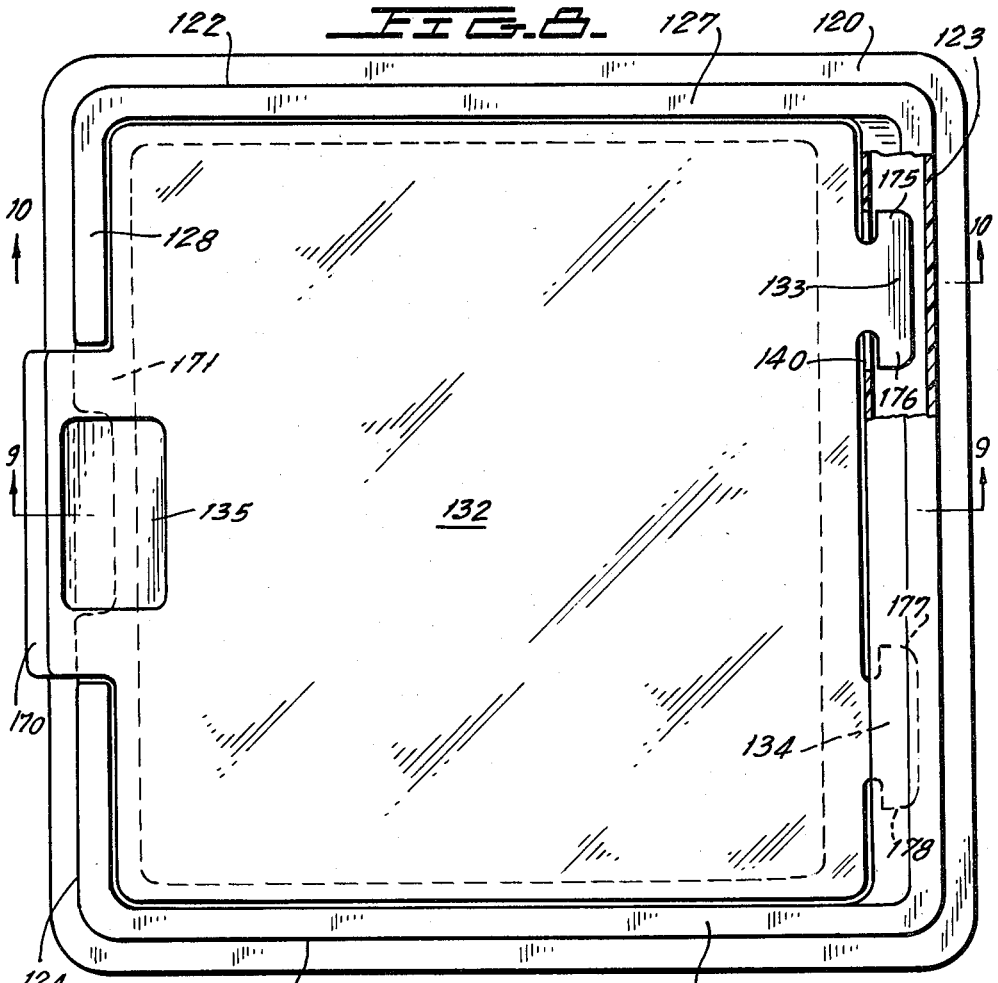
FIG. 9
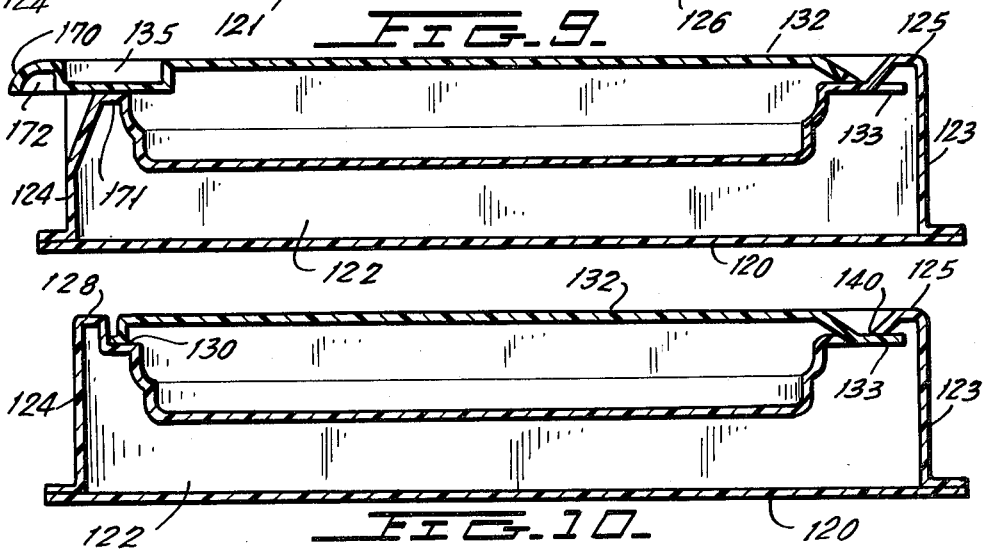
FIG. 10

FIG. 22.
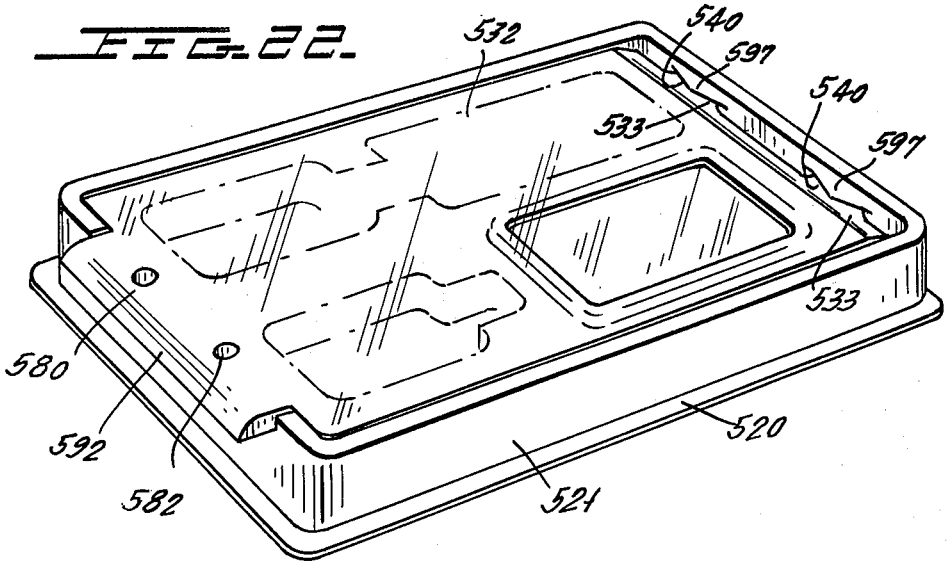
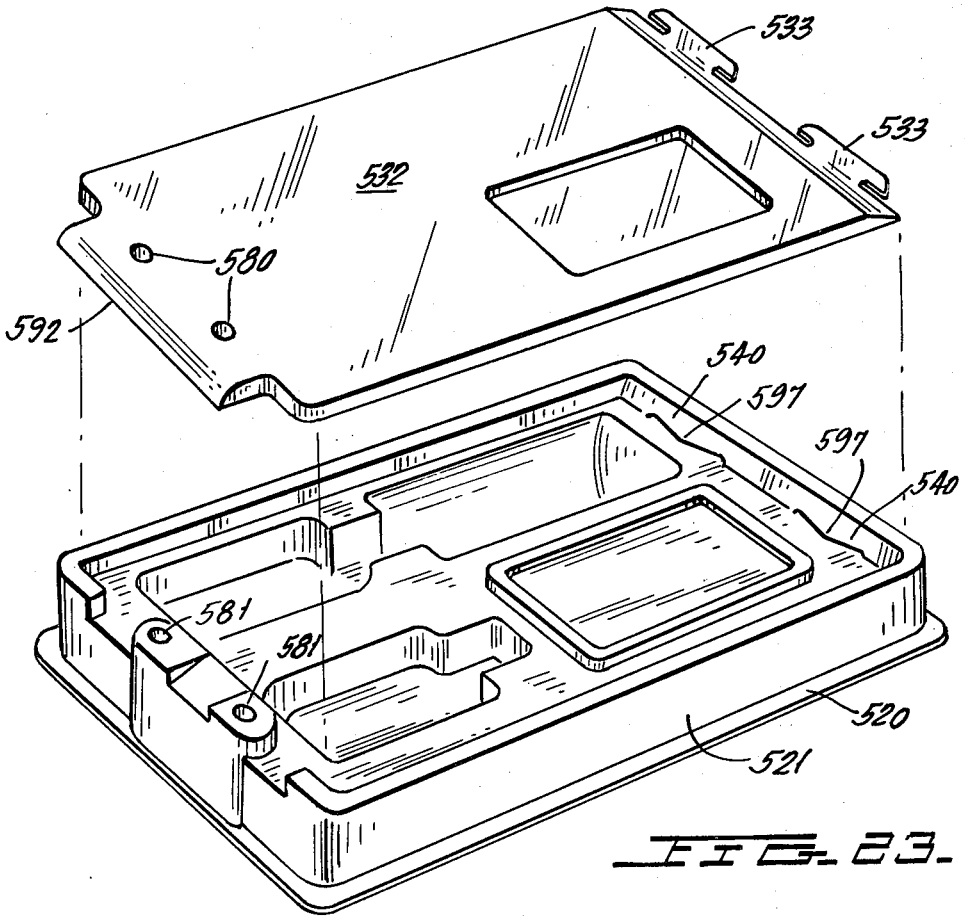
FIG. 23.

FIG. 24.
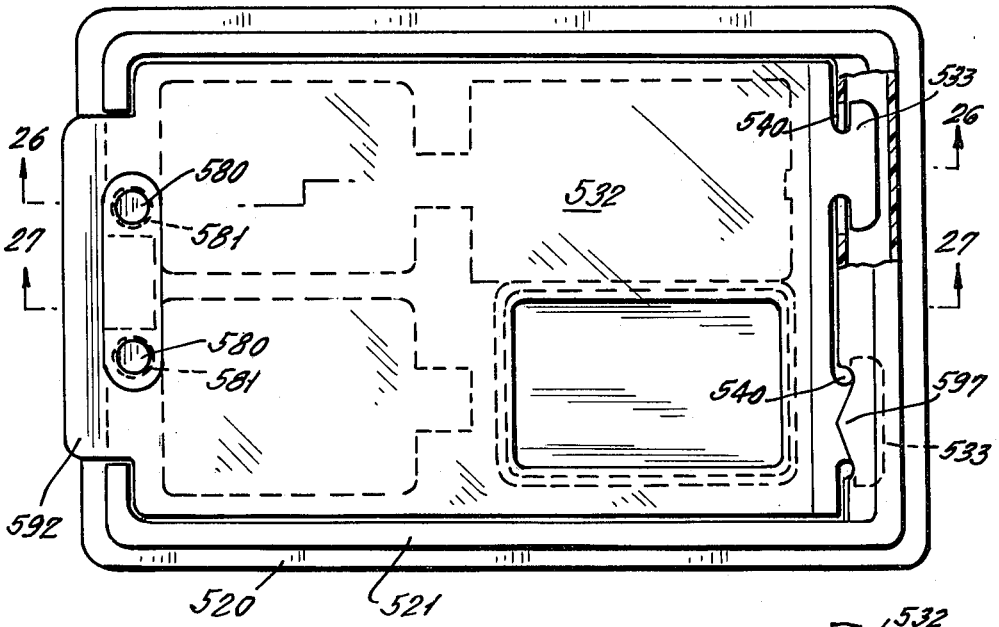
FIG. 25.
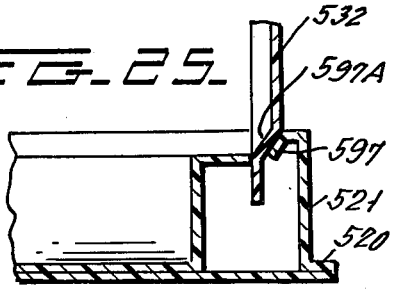
FIG. 26.
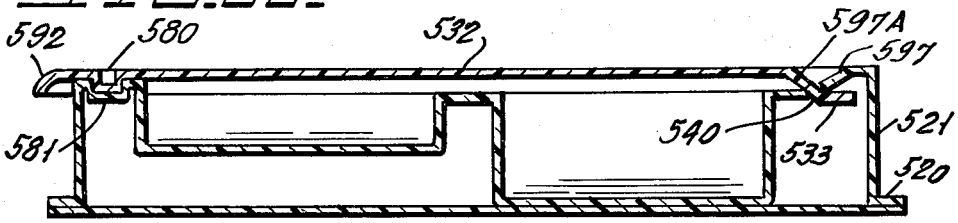
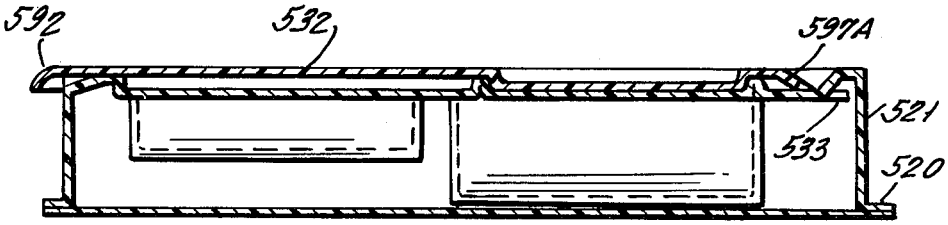
FIG. 27.

CONTAINER AND REMOVABLE COVER

The present invention relates to receptacles or containers of the type which will be ornamental in themselves and provide a simplified means for positioning and retaining cosmetic containers or other devices which may themselves be ornamental in character and which preferably should be available to view through the top of the container. Therefore, in most cases, the cover of the container will be transparent or translucent.

More specifically, the present invention relates to such ornamental decorative containers which, in turn, may hold ornamental and decorative devices in position, wherein the cover is so arranged that, while it may readily be removed from the container, it is captured at the top of the container in a simplified manner which permits the opening of the cover in the usual way by unsnapping one side of the cover which is hinged at the other end.

The present invention further relates to the utilization of a cover which is essentially planar and which, at one side, is provided with at least a tang or pair of tangs which will serve as hinge members when positioned as hereinbelow described and, at the opposite side, is provided with a resilient detent or snap means which will engage a portion of the container opposite the hinge members.

Containers of this general type have been used in various ways for display and housing of tools, cosmetics and other small items. Reliance has been placed in the prior art on the utilization of a bead at the rim of the container either running around the full periphery of the rim or at least substantial parts thereof and the utilization of a longitudinal detent member engaging the bead on all sides.

Such detent beads of this type have also been used in connection with tangs which can form a hinge member. However, the present invention is directed to the utilization of a cover of the said type wherein the cover is essentially planar, the hinge tangs extending outwardly from the cover in substantially the same plane as the cover and the detent or snap members at the opposite end of the cover engage with a portion of the container simimlarly opposite the hinge, snapping into or upon a portion of the container. This is accomplished without the necessity for a continuous peripheral detent on the cover itself and without the necessity for even a single long longitudinal detent along the side of the cover opposite the hinge.

Accordingly, the object of the present invention is to provide a simplified cover for a container wherein the cover comprises substantially a planar member having a pair of tangs extending in the plane of the cover at one end and having detent means at the edge opposite the tangs which will engage and snap into removable engagement with corresponding detent members on the container.

A further object of the present invention is the use of a cover for a container wherein the cover is essentially planar and the tangs, acting as hinge pieces, extend substantially in the plane of the cover where, however, the cover, when inserted, will rest upon a ledge within the periphery of the upper end of the container and wherein the cover is of sufficient size to be snapped into the periphery of the container to engage and rest upon the said ledge.

The foregoing and many other objects of the present invention will become apparent in the following description and drawing in which:

FIG. 3 is a top plan view of the cover of FIGS. 1 and 2;

FIG. 4 is a cross-sectional view of the cover of the container of FIGS. 1, 2 and 3, taken from lines 4—4 of FIG. 3 looking in the direction of the arrows;

FIG. 5 is a cross-sectional view corresponding to that of FIG. 3 showing the cover hingedly raised;

FIG. 8 is a top plan view of the container of FIGS. 6 and 7;

FIG. 9 is a cross-sectional view taken on line 9—9 of FIG. 8 looking in the direction of the arrows;

FIG. 10 is a cross-sectional view taken on line 10—10 of FIG. 8 looking in the direction of the arrows;

FIG. 22 is a view in perspective of another modified form of the container of the present invention;

FIG. 23 is an expanded view in perspective of the container of FIG. 22, showing the cover raised from the base of the container;

FIG. 24 is a plan view of the container of FIG. 22, showing the interrelationship of the tang-hinge elements at one end of the cover and the interlocking elements at the other end of the cover;

FIG. 25 is a cross-sectional view showing part of the interrelationship of the tang-hinge elements of the cover and the base;

FIG. 26 is a cross-sectional view taken on line 26—26 of FIG. 24 looking in the direction of the arrows; and FIG. 27 is a view taken on line 27—27 of FIG. 24 looking in the direction of the arrows.

Figure 1:
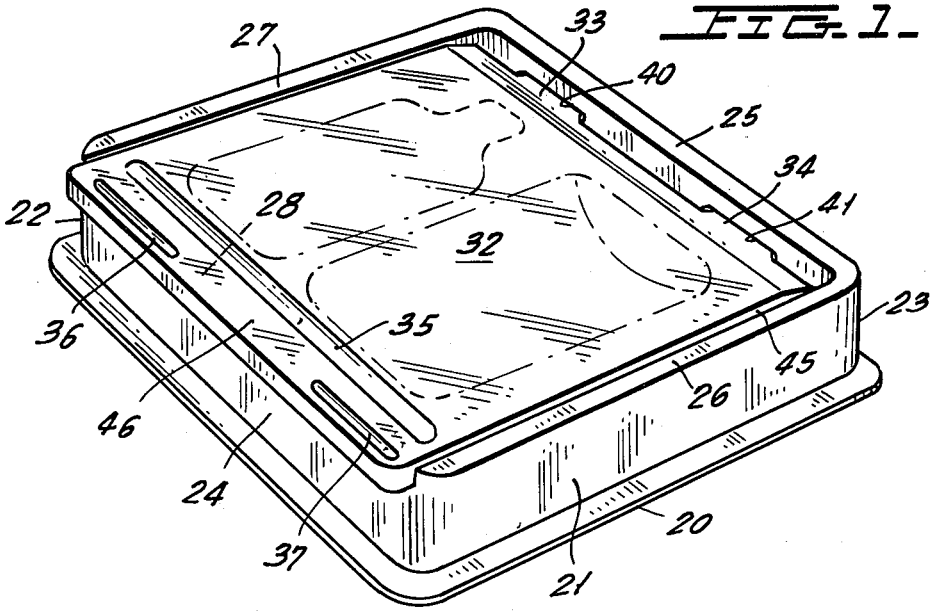
FIG. 1 is a view in perspective of a novel container and cover embodying this invention.

Referring now to the FIGURES, it should be kept in mind that the essential element of the present invention is not merely the provision of tangs which act as hinges, but the combination of tangs (which act as hinges to be inserted in slots in the container and removable therefrom) together with a detent arrangement at the opposite end of the cover which does not necessarily engage the entire periphery of the container or even a single longitudinal edge of the container, but which combines with the tangs which have been inserted in slots at the periphery of the container at one side and detent elements opposite in order to hold the cover removably in place.

In each case, the cover may then be lifted up by disengaging the end opposite the hinge tangs from the periphery of the container and thereby lifting the cover as if it were a hinged cover. The cover may be entirely removed by snapping the tangs out of the slots into which they are inserted. The tangs themselves may be simply integral members which extend from the edge of the cover without any specific shape, or the tangs may have a detent shape themselves so that they must be snapped into the slots at the periphery of the container with which they cooperate.

In the latter case, while the cover and tangs are removable, they must be manipulated to be removed and, for all practical purposes, the cover stays a part of the container until the user specifically desires to remove the cover; and one does not fall out of the container simply by reason of the opening of the cover.

Referring first to FIGS. 1 through 5, there is here shown a container having a bottom wall 20, a pair of side walls 21, 22, a rear wall 23 and a front wall 24. The edges of these vertical walls of the container of FIG. 1 terminate in the peripheral rear top edge 25, the two side top edges 26, 27 and the front top edge 28. These edges are not sharp edges as shown, but rather have substantial width since they are intended to be ornamental and will participate in the locking arrangement as hereinafter described.

The top opening in the container just below the edges 25, 26, 27 and 28 is provided with a peripheral ledge 30, see particularly FIGS. 4 and 5, just below the top of the container and providing a support for the cover 32.

The cover 32 is provided with rearwardly extending tangs 33, 34 and forward detent elements 35, 36, 37 opposite the rearwardly extending tangs 33, 34. At the wall 25 at the junction between the peripheral ledge 30 and the wall 23, a pair of slots 40, 41 are provided in the container. These slots receive the hinge tangs 33, 34.

It will be noted that in this case, the cover 32 is provided with a short downwardly depending peripheral flange 45 which will rest on the ledge 30. When the tangs 33, 34 are slipped into the slots 40, 41 and the cover is then rotated down, the lower edge of flange 45, which is a peripheral flange, will rest on the internal ledge 30 of the container just below the periphery of the container. The longitudinal detent member 35 and the sort detent members 36, 37 at the end of the cover 32 opposite the hinge tangs 33, 34 will snap over the edge 28 of the container and thereby resiliently lock the cover 32 in place. An upward pull at the center area 46 of the cover which now extends as seen in FIGS. 1, 4 and 5 beyond the wall 24, will dis-engage the detent elements 35, 36, 37 from the edge 28. In this case, it is not necessary to have a full groove detent element in the cover. The utilization of the longitudinal detent member 35 and the shorter detent members 36, 37 provide sufficient locking. In addition, the detent elements 36, 37 may have a slight inward bias toward the hinge end of the cover, thereby making it possible for the detent elements 36, 37, as seen in FIG. 5, to enter into the detent notches 47, 48 at the front wall 24 of the cover just below the periphery 28, providing an additional resilient lock. See also the detent locks in FIG. 14, hereinafter described, and the locking devices shown in FIGS. 17 to 21, also hereinafter described.

The front wall 24 of the container is provided with recesses 50, 51 adjacent the opposite side walls 21, 22 to provide room for the peripheral flange 45 to be received fully within the container in the condition shown in the cross-sectional view of FIG. 4.

In this case it will be seen that while, because of the small flange 45, the tangs 33, 34 are not in the identical plane of the main cover 32, they are substantially in the same plane and opposite the detent members 35, 36, 37. It will be noted that it is the combination of these resilient detent members and the hinge tangs in substantially the same plane that provides the snap cover arrangement which is an essential element of the present invention.

In FIGS. 6, 7, 8, 9 and 10, there is shown a modification of the container of the present invention which is substantially the same structure as that shown in FIGS. 1 to 5 and, therefore, corresponding elements have been given the same reference numbers with the addition of 100, so that, for instance, the front wall of the container is 124 and all other elements corresponding to those shown in FIGS. 1 to 5 have the same reference number with the addition of 100, except as additionally marked.

Figure 6:
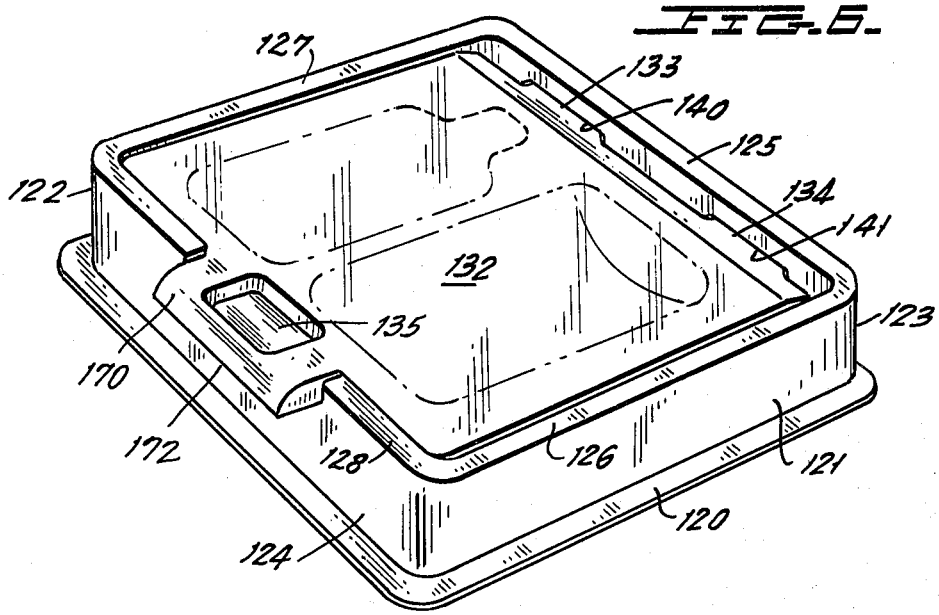
FIG. 6 is a view in perspective of another form of the present invention wherein the cover is fully planar without any depending elements of any kind except at the fastening end.
Figure 7:
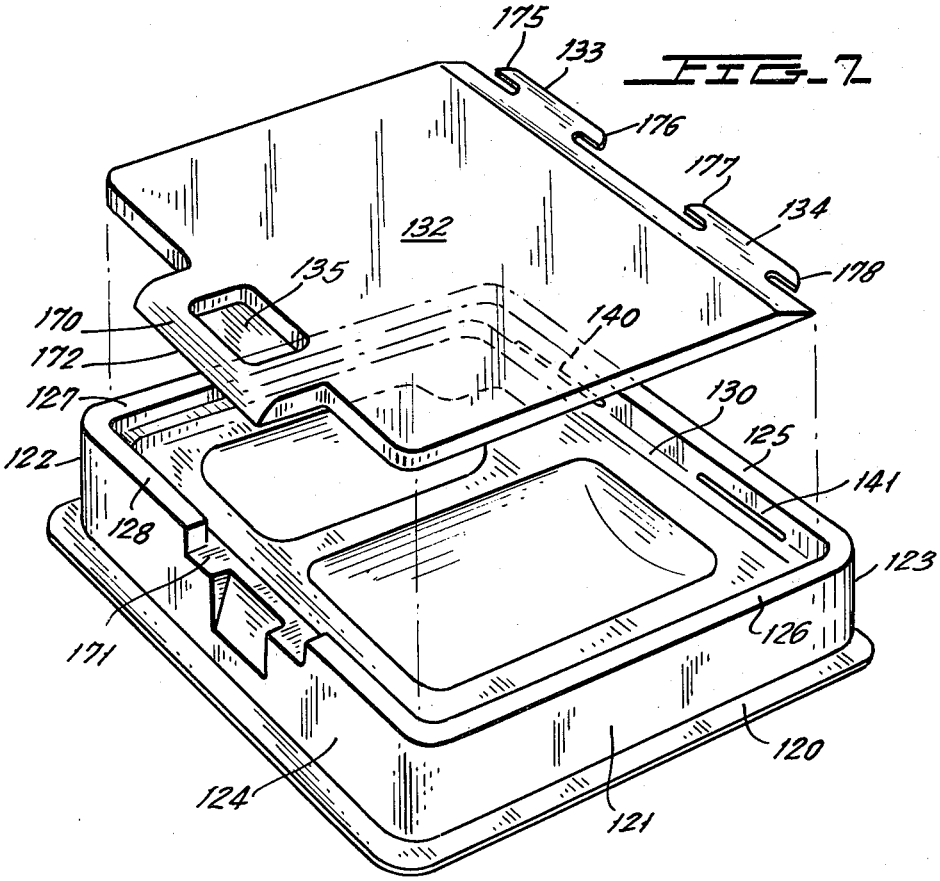
FIG. 7 is a view in perspective corresponding to the view of FIG. 6 showing the cover lifted off.

In the case of FIGS. 6 to 10, the locking arrangement comprises an extension 170 having a width substantially equal to or at least a tight fit in the notch 171 in the front wall 124 so that when the cover is turned down to complete the structure as shown in FIG. 6, the member 170 is a close frictional fit in the gap 171. It extends beyond the gap 171 as shown in FIGS. 6, 8 and 9 so that the extension 172 thereof provides means for grasping the end of the member 170 and the cover 132 to rotate the same about the tangs 133, 134.

In this case, the tangs 133 and 134 are provided with lateral extensions 175, 176, 177 and 178 which are capable of snapping into the slots 140, 141 to capture the cover so that it may not accidentally be removed. However, the cover may be removed since the extensions 175, 176, 177, 178 of the tangs 133, 134 are flexible and may, with sufficient force, be snapped out of the slots 140, 141.

Figure 11:
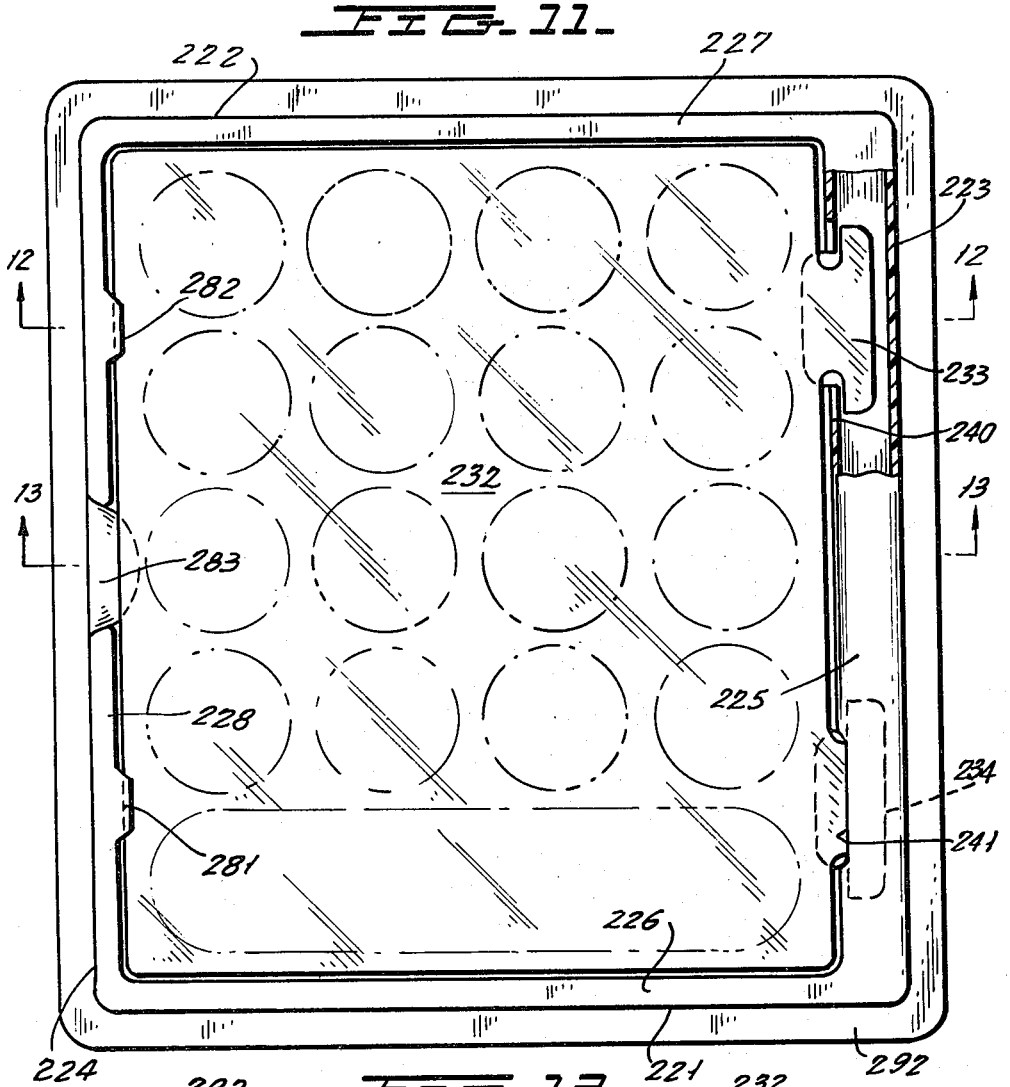
FIG. 11 is a view of another container embodying the elements of the present invention wherein the cover element and the tangs extending therefrom for hinge members correspond to the tangs of FIGS. 8, 9 and 10, but wherein the detent locking elements on the opposite surface are recessed.
Figure 12:
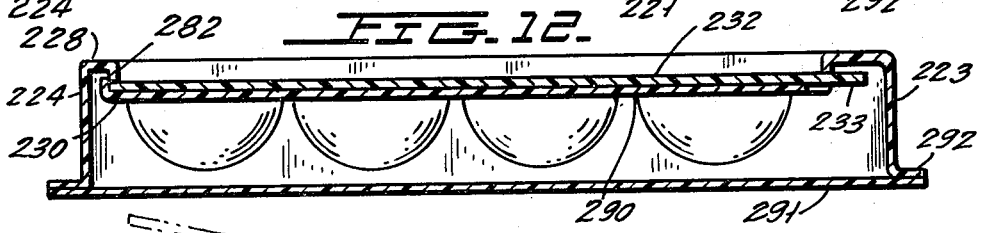
FIG. 12 is a cross-sectional view taken on line 12—12 of FIG. 11 looking in the direction of the arrows.
Figure 13:
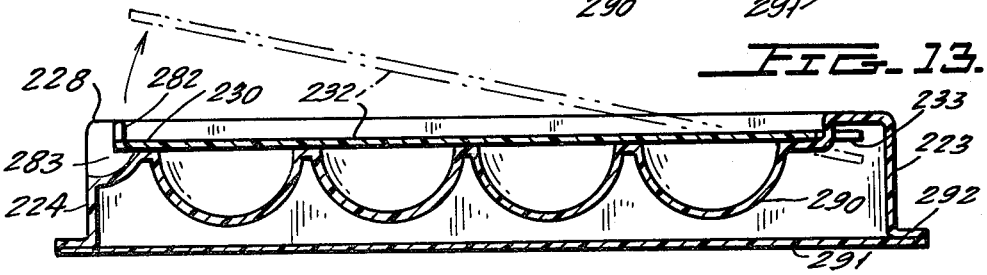
FIG. 13 is a view corresponding to that of FIG. 12 showing the cover raised.

In FIGS 11, 12, and 13, there is shown a preferred structure of the present invention wherein the cover 232 and the tangs 233 and 234 are absolutely co-planar and wherein the ledge 230 provided just beneath the top edges 224, 225, 226, 227 is utilized in part as the element which exerts the detent force. In this case, the hinge tangs 233, 234, as previously pointed out, are absolutely co-planar with the cover 232 and no specific detent means are provided on the cover itself. However, when the cover is rotated down onto the ledge, the front wall 224, provided with a pair of inwardly extending detents 280, 281 past which the front of the cover opposite the hinge section snaps, and thereby engages the cover which now rests on the ledge 230. The cover is now held in position at the hinge end by the hinge tangs 233, 234 and at the front end by the detent members 281, 282. A recess 283 may be provided in the front wall 224 so that insertion of the tip of a finger will be sufficient to raise the cover. In this case, it should be pointed out that instead of being merely substantially co-planar, the cover and the hinge members extend in the same plane. The detent member need not even be positioned on the cover itself, but is provided at the front wall 224.

In each case, the container may be decoratively arranged whereby the container itself may be provided with recesses for positioning desirable articles which should be displayed through the cover, when it is transparent and which will positively hold the articles in position. It will be noted that while the tangs 233, 234 may have the form shown in FIG. 2, preferably, they have the form shown in FIG. 7 so that the cover will remain part of the container. But the extensions 275, 276, 277 and 278 from the tangs can be deformed in order to permit the tangs to be inserted in the corresponding slots and can be manipulated to be snapped out of the those snaps, if desired. Normally since the cover can be rotated through a substantial angle to provide full access to the contents of the container, such slipping out of the cover will not be necessary.

It will be noted in the structure of FIGS. 11 to 13 that the container has a principal bottom wall 290 which may be molded and formed to provide recesses and positioning elements for various articles and an additional bottom wall 291 which may be secured in any suitable manner as by adhesive, to an extending peripheral ledge 292 of the container at the bottom in order to provide a finishing piece for the bottom of the container.

Figure 16:
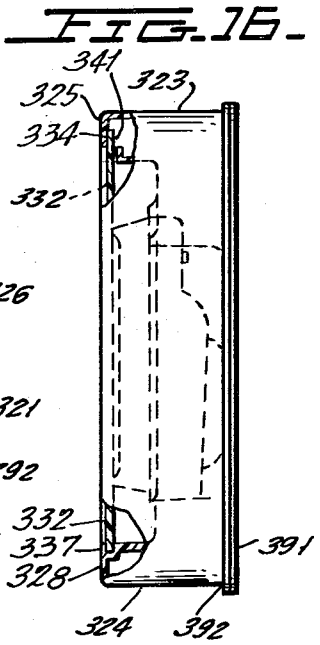
FIG. 16 is an end view of the structure shown in FIG. 14.
Figure 14:
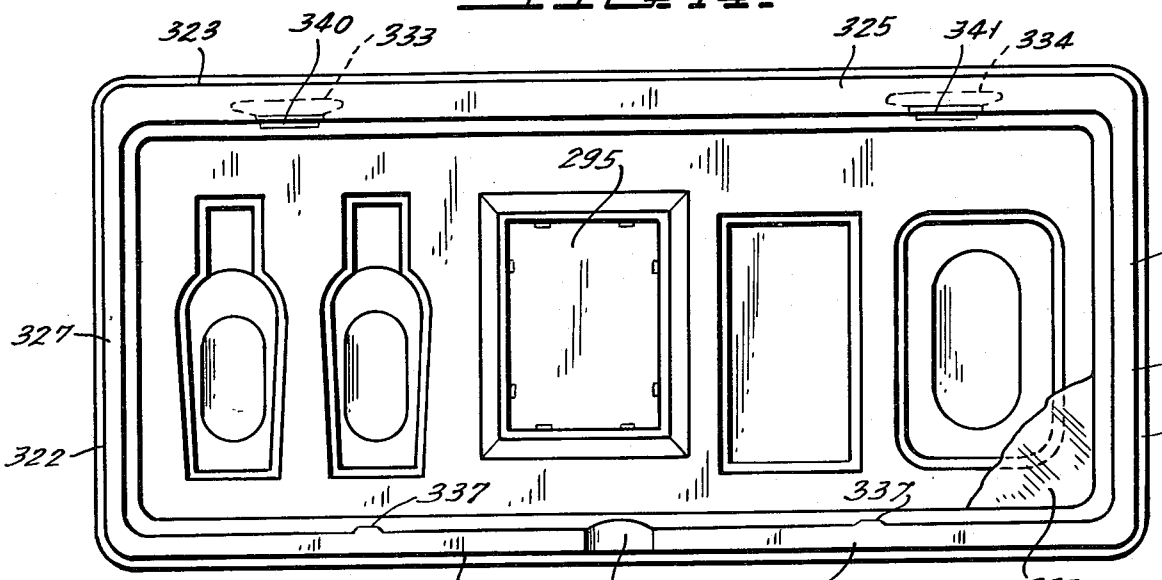
FIG. 14 is a top view of another modified and preferred form of the present invention.
Figure 15:
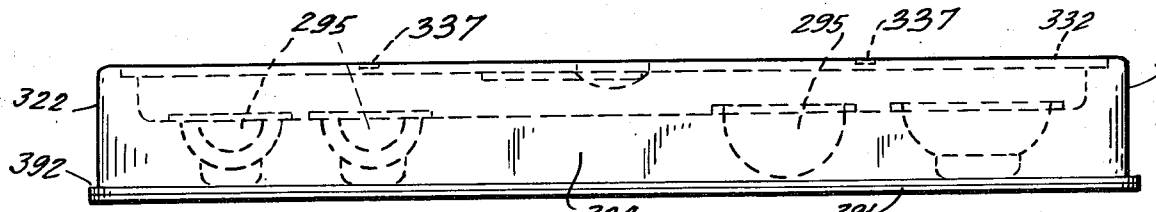
FIG. 15 is a side view of the structure shown in FIG. 14.
Figure 17:
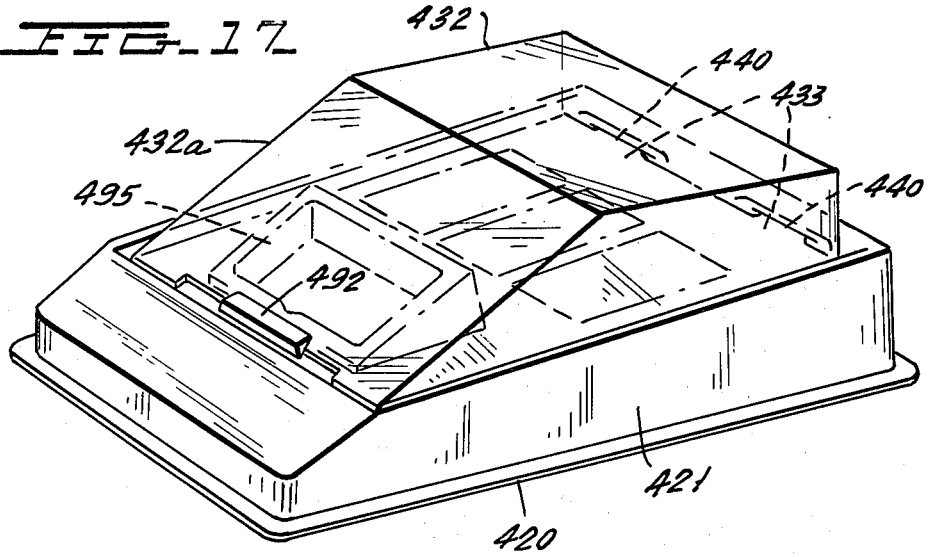
FIG. 17 is a view in perspective of a further modified container of the present invention showing a modified form of releasable closure element for the hinged cover.
Figure 18:
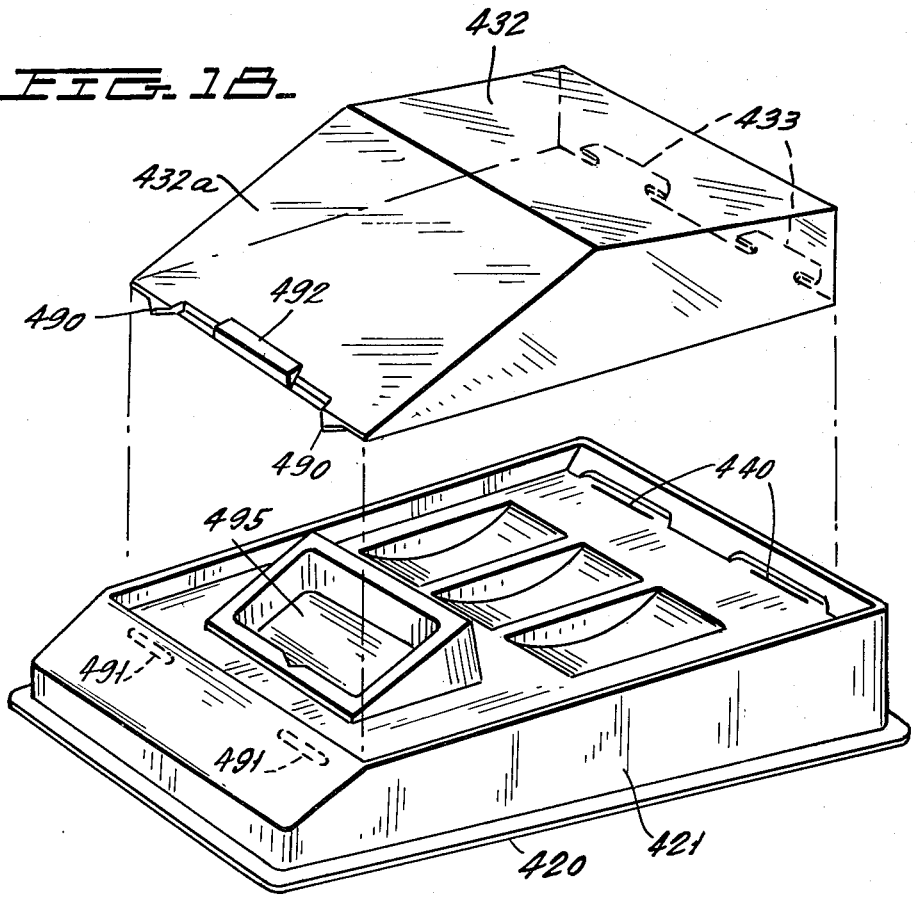
FIG. 18 is an expanded perspective view of the structure of FIG. 17, showing the cover completely raised from the base.
Figure 19:
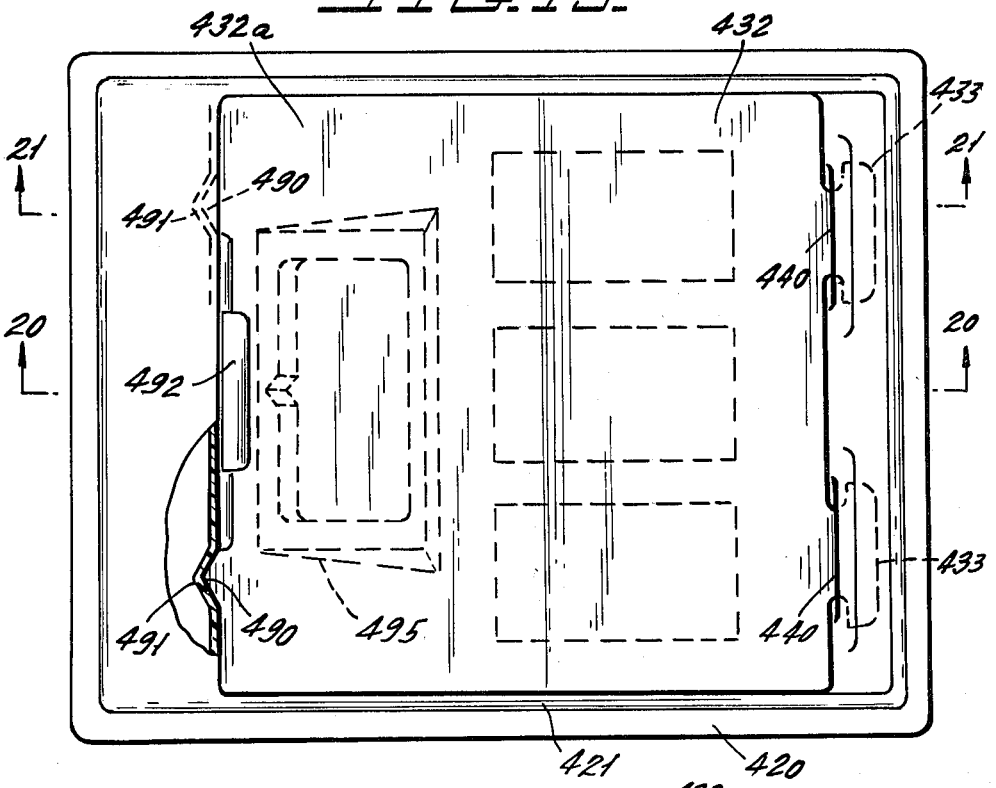
FIG. 19 is a plan view of the container of FIG. 17 showing particularly the interlocking arrangement for the end sections of the cover and container which form the hinges and showing also the cover locking arrangement.
Figure 20:
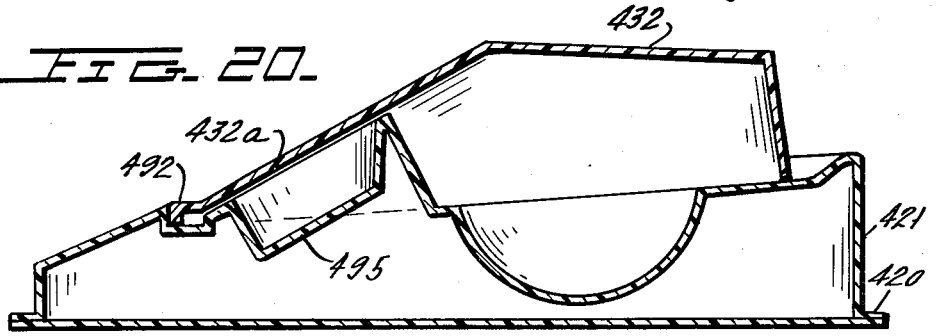
FIG. 20 is a cross-sectional view taken on line 20—20 of FIG. 19 looking in the direction of the arrows.
Figure 21:
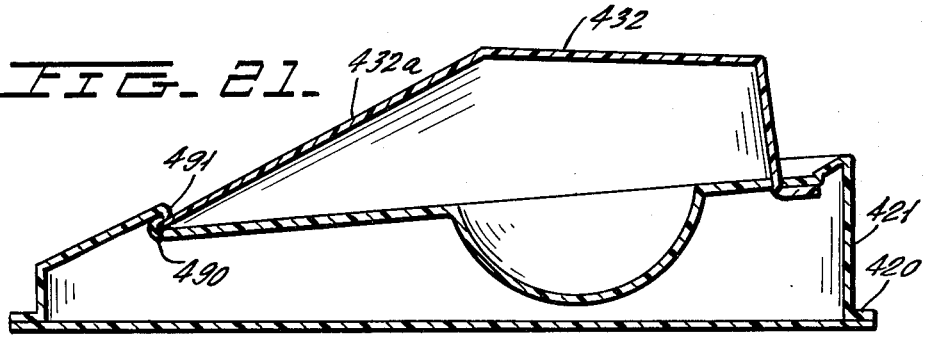
FIG. 21 is a cross-sectional view taken on line 21—21 of FIG. 19 looking in the direction of the arrows.

In FIGS. 14, 15 and 16, there is shown a further development of the container of FIGS. 11, 12 and 13 in which a substantial structure may be utilized in exactly the same manner as in FIGS. 11, 12 and 13 and to which reference numbers identical with those in FIGS. 11, 12 and 13 have been applied, except that each reference number has had 300 added to it; for instance, the cover in FIGS. 13, 14, 15, 16 has the reference number 332. This structure is substantially identical with that shown in FIGS. 11 to 13 as to function, but demonstrates how various articles of merchandise may be presented in various ways with the bottom wall 390 preshaped to support the articles of merchandise; and even being preshaped, not only with recesses, as in the structure of FIGS. 11 to 13, but also, if desired, with an upwardly extending embossment 295 which may carry appropriate logos or other material. The detents 337 on the base constitute latches for retaining the edges of cover 332.

Turning now to FIGS. 17 to 21, there is here shown a further modified form of container and cover member which essentially follows the principles previously set forth in connection with FIGS. 1 to 16 and, consequently, the structure therein shown have been given the same reference numerals with the addition of "400". For instance, the cover member in FIGS. 17 through 21 has the reference number 432. This structure is substantially similar to the other structures including a hinge member 433 which corresponds in function and operation to the hinge member 133 of FIG. 9. An appropriate comparison may be made between FIG. 21 and FIG. 10 to show the substantial similarity of operation at the hinge.

Figure 2:
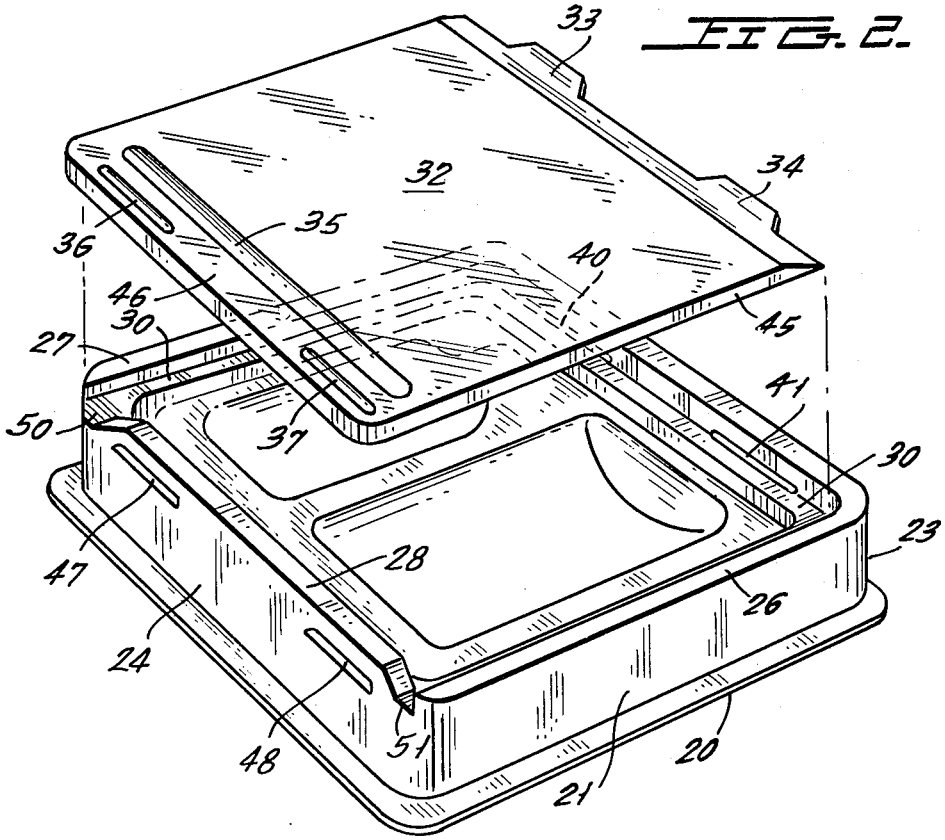
FIG. 2 is a view corresponding to that of FIG. 1 with the cover lifted up out of engagement with the container.

The base 420 of the container with its wall 421 corresponds to base 20 and wall 21 of FIG. 2 and is provided with similar ornamental recesses such as the recesses 495 which appear in the other Figures.

The essential advance of the structure of FIGS. 17 to 21 is the provision of the extended locking detent members 490, 490 which cooperate with the recesses 491 (see FIG. 21) and which, because of the flexibility of the cover member, may be snapped into the said recesses to hold the structure in place.

In addition, the slanting cover section 432A of the cover 432 is provided with a thumb operated pressure member 492 which, when pushed by the thumb toward the rear, will pull the latching extensions 490 out of the recesses 491. The slanting section 432A of the cover 432, in this case, matches the inclination of the edge of recess 495, thereby providing a finished appearance for the structure and also serving to retain in position anything placed in that recess so that the material therein will be limited in its movement with respect to the recess when the cover is closed.

In FIGS. 22 to 27, there is shown a further modified form of structure which operates in common with the elements shown in the prior structures and are given the same reference numbers, plus 500. The cover 532 is provided with the hinge tangs 533 which operate in the manner previously described for the other hinge tangs 33 and so on, as described in connection with the previous structures.

However, the slots 541 and 540 into which the hinge tangs 533 are snapped, are provided at their upper edge with the inwardly extending substantially triangular members 597, 597 which have the function when the cover 532 is raised to a vertical position, as shown in FIG. 25, to act as detents which snap into position under the bevel 597A of the cover to hold the cover 532 in its vertical position.

The flexibility of the cover permits this to occur and thus the cover is so arranged that it may be snapped into vertical position and then be snapped downwardly once more. The detent pointed extensions 597, thus in a closed position of the cover, tend also to maintain the cover in this closed position.

At the opposite end of the container shown in FIGS. 22 to 27, the cover is provided with a pair of cylindrical elements 580, 580 connecting with the thumb operated release structure 592. The upper surface of the wall 521 of the base is provided with cylindrical recesses 581 which receive the cylindrical elements 580. The relationship between the cylindrical elements 580 of the cover and the cylindrical recesses 581 on the top edge of the front of the base opposite the hinge section is such that there is a good friction fit between them when the cover is closed. Also, the slight distortion of the cover itself, when the members 580 engage the elements 581, serves to enhance this frictional fit. The thumb operated member 592 extending beyond the front wall of the container provides a means which is readily accessible so that the thumb may be utilized to lift the cover from the frictional locking engagement.

In all of the foregoing, it will be clear that the structure comprises a cover member which is so arranged that the hinge members constitute tangs which will enter into slots adjacent the top of the container at one end. The container is provided with a ledge on which the cover member rests. At the opposite end, detent members are provided which will cooperate at the front of the container to hold the cover in place. In one form, the detent member comprises detent extensions parallel to the front cover (FIGS. 1 to 5) which receive the top edge of the front wall of the container which may or may not be combined with additional detent notches in the front wall of the container in order to further interengage with the detents on the cover.

In a second structure (FIGS. 6 to 11), the detent structure comprises an extension of the cover beyond the front wall of the container which fits into a notch in the front wall to provide a frictional engagement.

In the preferred form, the cover and the hinge tangs are completely co-planar. The hinge tangs are provided with means for firmly interengaging slots adjacent the top wall of the container at one end and the opposite edge of the container is detented by an extending resilient formation adjacent the top edge of the wall opposite the hinge wall.

In all cases, while the utilization of tangs for hinges has been known and while the utilization of detent elements have been known in order to maintain a cover in place, the combination has not previously been known and is completely and surprisingly novel and different from that elsewhere shown.

The utilization of an essentially planar cover with the tangs at one end for hinges and the detents at the other end for maintaining the cover in place comprises an essential element of the present invention.

In addition, it is now obvious from the description herein set forth, that the base and the cover may be made of different materials. The cover may be made transparent. The cover may also consist of an ornamental grille work, partly transparent and partly of opaque material, through which the contents may readily be seen. Under desired circumstances, the cover may be of any opaque material. Similarly, the base member may be made of any desired material which can be formed, shaped or otherwise constructed to provide retaining elements for the contents. Thus, both the cover and the base may be made of transparent, partly opaque or opaque material, a material with grille-work or fret work which provides a partial transparency. The cover or the base or both may be made of paperboard, or of lucite, or of wood and, of course, as previously pointed out, may be made of clear or solid plastics and of metal and of other materials.

It will be obvious from the foregoing description that while the base primarily has a conformation to position various structures therein, the base may be formed as a container with a single inside area, not partitioned off, although the partitioning is preferred. The covers can be formed in virtually any shape that is desirable, keeping in mind the aesthetics of the structure, the intended contents of the container and the artistic or mechanical interrelationship of the cover and the contents of the base. Thus, as for instance in the structure of FIGS. 17 to 21, the slant of the cover may be arranged in such manner as to provide a further enclosure for an embossed container section within the container.

In the foregoing, the present invention has been described solely in connection with preferred illustrative embodiments thereof. Since many variations and modifications of the present invention will now be obvious to those skilled in the art, it is preferred that the scope of this invention be determined not by the specific disclosures herein contained but only by the appended claims.

What is claimed is:

1. A container having side walls and a front wall, a back wall, a bottom wall and an open top, a ledge extending within the open top of the container below the top edge of each of the walls;

at least one slot at said back wall between said ledge and said back wall accessible above said ledge;

a cover member having an extending tang, said tang being insertable in said slot, said cover member being dimensioned to enter said top of said container and to rest on said ledge and detent means at the front wall of the container for maintaining said cover in place when it is rotated from an open position hinging upon said tang and slot to a closed position where the cover rests upon said ledge.

2. The container of claim 1, wherein said detent means comprises at least a pair of spaced extensions on said cover directed toward the top edge of the front wall of said container;

said pair of extensions extending parallel to the front edge of the cover and receiving the top edge of said front wall between them.

3. The container of claim 2, having a pair of notches in said front wall at opposite ends of said front wall to permit a portion of said cover to pass therethrough at the front corners of said container in order to permit said container to close completely.

4. The container of claim 3, wherein a portion of said cover extends beyond said front wall and is accessible for finger engagement to disengage said detents.

5. The container of claim 1, wherein said front cover, when rotated about said tang and slot rests upon said ledge and detent members extending inwardly from the top of said front wall resiliently and releasably engaging said cover.

6. The container of claim 5, having a finger hole at the top edge of said front wall to provide access to the forward edge of said cover.

7. The container of claim 1, wherein said cover is provided with a central extension at the front thereof opposite tang and slot, and a recess in said front wall frictionally receiving said extension, said extension being resiliently held in said recess and extending beyond said front wall so that it may be engaged by a finger to raise the same.

8. The container of claim 5, wherein a plurality of tangs and corresponding slots are used at said rear wall for the hinge and where each tang is provided with lateral extensions slightly wider than the slot into which the tang is inserted so that said extensions extend beyond the ends of said slots when the tangs are inserted therein and wherein said tangs and extensions may be resiliently manipulated to be inserted into said slots and may correspondingly be manipulated to be removed therefrom.

9. The container of claim 8, wherein the container is provided at its bottom wall with recesses for positioning articles therein and wherein a finishing bottom wall is provided to cover the underside of said recesses.

10. The container of claim 1, wherein said detent means at the front wall of the container comprises at least one recess and wherein the front of the cover of said container, opposite the extending tang, includes a projection extending horizontally therefrom and entering said recess;

said extension being releasably removable from said recess.

11. The container of claim 1 wherein said detent means at the front wall of the container comprises at least one substantially vertical opening in the said wall and a corresponding extension from the front edge of the container; said corresponding extension being a friction fit in said opening in said front wall.

12. The container of claim 10 wherein the front wall detent structure comprises a pair of extensions and a pair of recesses and wherein a ridge is provided between said pair of recesses which, on application of pressure along the plane of the cover, may remove said detents from said recesses.

13. The container of claim 11 wherein an additional extension is provided at the front of said cover and where said detent members comprise two spaced apart recesses in said front wall and two corresponding members on the cover for engagement therein and wherein the said extension of said front cover provides a member engageable by the fingers for raising the front of said cover.

14. The container of claim 1 wherein the wall of said slot which engages the upper surface of said cover extends into the container beyond the slot providing an extension engageable with a portion of the surface of said cover when said cover is raised; said extension of said wall of said slot being deformable when the cover is raised to hold said cover in raised position.

15. The container of claim 14 wherein said cover adjacent said hinge tang is provided with a slanted rear edge slanting outwardly away from the top of the cover and wherein said extension of the wall of said slot engages said slanted section of said cover, when said cover is raised to resiliently maintain said cover in raised position.

* * * * *